United States Patent [19]

Johnson et al.

[11] 4,116,604

[45] Sep. 26, 1978

[54] CORNER FINISHING TOOL

[75] Inventors: Eugene R. Johnson, Burlingame; Morris F. Mower, Santa Clara, both of Calif.

[73] Assignee: Bliss & Laughlin Industries, Inc., Oak Brook, Ill.

[21] Appl. No.: 809,279

[22] Filed: Jun. 23, 1977

[51] Int. Cl.[2] ..... B05C 17/10; B29C 23/00

[52] U.S. Cl. ..... 425/458; 425/87; 15/235.7

[58] Field of Search ..... 15/235.4, 235.5, 235.6, 15/235.7, 235.8, 236 R; 425/87, 458

[56] References Cited

U.S. PATENT DOCUMENTS

| | | | |
|---|---|---|---|
| 1,938,260 | 12/1933 | Morris | 425/87 X |
| 2,178,899 | 11/1939 | Shaffer | 15/235.7 |
| 2,594,606 | 4/1952 | Ames | 425/87 |
| 3,932,101 | 1/1976 | Johnson et al. | 425/87 X |
| 4,032,283 | 6/1977 | Johnson et al. | 15/235.7 X |

FOREIGN PATENT DOCUMENTS

| | | | |
|---|---|---|---|
| 506,231 | 10/1954 | Canada | 15/235.7 |

*Primary Examiner*—Francis S. Husar
*Assistant Examiner*—John S. Brown

[57] ABSTRACT

Improvements in corner finishing tools for applying mastic material along a wall joint and comprising an improved means for adjusting the resilient flex between integral sides of a mastic retainer plate; an improved retainer plate having elongated interior pockets formed directly in front of a pair of doctor blades to receive and store mastic material and to collect small foreign particles, and baffle plates to direct the flow of mastic material; and an improved means for supporting the tool including a pair of side rollers rotatably mounted peripherally of an interior mastic cavity.

6 Claims, 8 Drawing Figures

CORNER FINISHING TOOL

This application relates generally to corner finishing tools for applying mastic material along a wall joint. Tools of this general kind are presently known and the invention described herein is believed to be an improvement thereon. More particularly, the corner finishing tool of the present invention incorporates many of the same features and designs shown and described in U.S. Pat. No. 3,932,101, but also incorporates several improvements thereon.

A principal object of the present invention is to provide a corner finishing tool that is easy to operate and which deposits a controlled amount of mastic material onto the corner of a wall joint.

Another object of the invention is to provide a corner finishing tool having an improved means for adjusting the resilient flex between a pair of integral sides of an angular mastic retainer plate.

A still further object of the invention is to provide a corner finishing tool of the kind described including improved means for supporting and positioning the tool for ease of operation.

And yet a further object of the invention is to provide a corner finishing tool that is capable of receiving and storing mastic material (and collecting small foreign particles) directly in front of a pair of doctor blades.

Other objects of the invention will become apparent in view of the following detailed description.

In the drawings, forming a part of this application, and in which like parts are identified by like reference numerals throughout the same:

Figure 1:
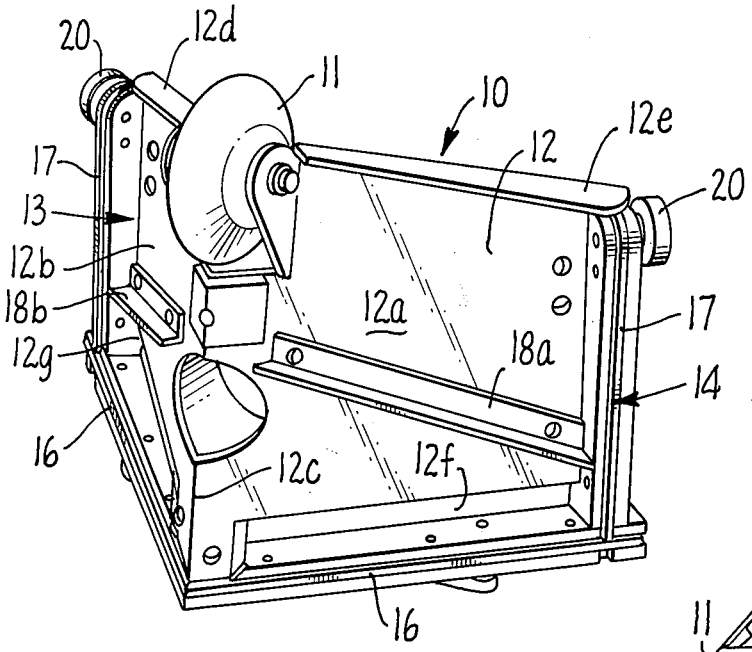
FIG. 1 is a perspective view of a preferred embodiment of the invention in a corner finishing tool.
Figure 2:
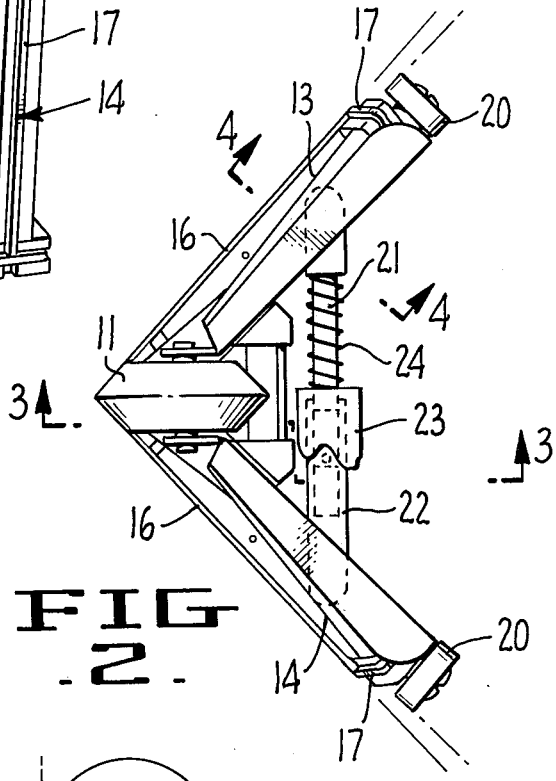
FIG. 2 is a top plan view of the finishing tool.

Referring to FIG. 1, finishing tool 10 essentially comprises a container means for mastic material defining a cavity that is open in two convergent and substantially perpendicular planes and having surfaces that converge peripherally of the cavity for doctoring mastic material that flows thereunder. In that regard, tool 10 is not unlike the prior art. Moreover, tool 10 further includes a wheel 11 formed with substantially conical side surfaces that converge to a center rim, a structural feature shown and described in U.S. Pat. No. 3,932,101. Notwithstanding, however, and unlike other corner finishing tools known to applicants, tool 10 embodies several improvements in construction which facilitate operation of the tool and contribute measurably to the effective application of mastic material to a wall joint.

Figure 3:
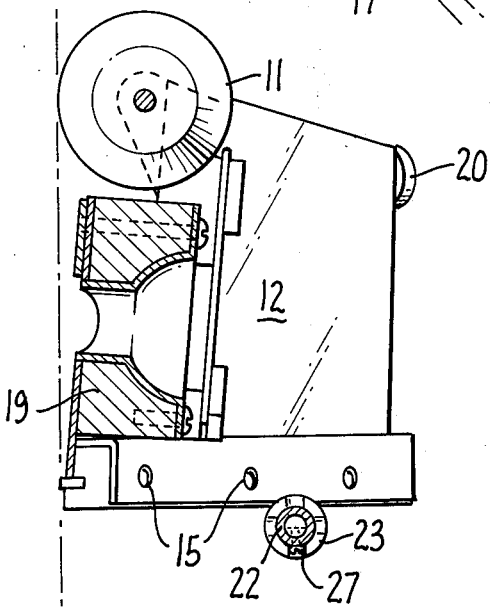
FIG. 3 is a vertical section taken on line 3—3 of FIG. 2.
Figure 5:
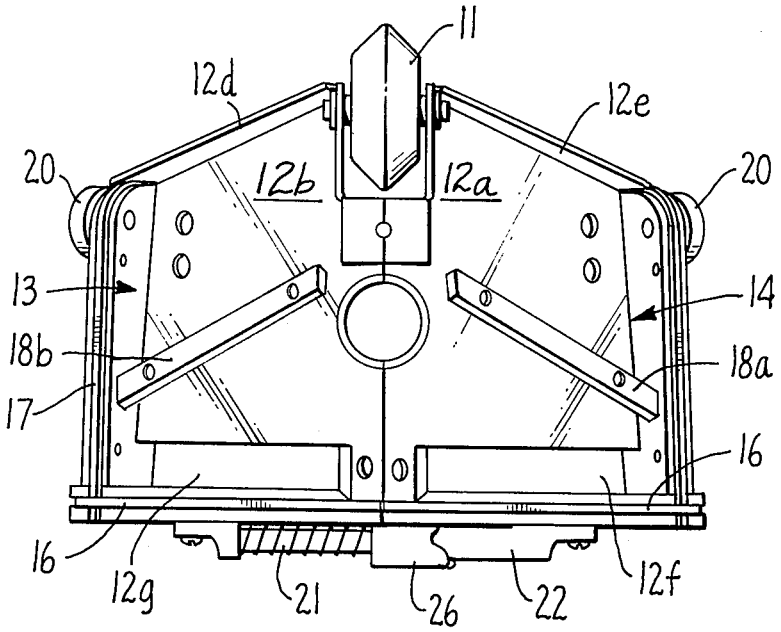
FIG. 5 is a front elevation of the tool.

In general, tool 10 comprises an angular retainer plate 12 made of resilient material, such as spring steel, and having a pair of integral sides 12*a*, 12*b* resiliently joined at a corner 12*c*, and a pair of upper flanges 12*d*, 12*e*. A pair of L-shaped rigid frame members 13 and 14 are secured to the lower and side edges of retainer plate 12 be means of machine screws 15 (see FIG. 3). The lower and side legs of each frame member are slotted to receive a doctor blade 16 and a skid 17. Doctor blades 16 come together at approximately a 90° angle near the corner edge 12*c*, while skids 17 extend upward from the ends of blade 16, thereby framing an interior mastic cavity.

One important feature of the present invention resides in forming a pair of elongate interior pockets 12*f* and 12*g* in the integral sides 12*a* and 12*b*, each pocket being located directly in front of doctor blade 16. These pockets serve to collect any excess of mastic material dispensed into the cavity of the tool while simultaneously serving as a reservoir of mastic material in the critical area immediately in front of the doctor blades. The use of such pockets, it has been found, enhances the application of mastic material by providing an even flow of mastic material beneath doctor blades 16. It has also been found that the pockets serve as a collection chamber for small wall board particles or foreign matter picked up by the tool as it is moved along the wall joint. This foreign matter may then be removed periodically from the pockets without interferring with the application of mastic material by the tool.

Means is further provided to insure proper filling of pockets 12*f* and 12*g* with mastic material. More particularly, a pair of baffle plates 18*a*, 18*b* are secured to the inner surfaces of sides 12*a*, 12*b*, each plate extending from and above the opening through which mastic is inserted, diagonally across the plate to a point slightly above but adjacent the end of one pocket. Thus, baffle plates serve to restrict the forward flow of mastic material, producing a buildup and forcing the material to flow in a direction toward pockets 12*f* and 12*g*.

A conventional socket bracket 19 is secured to plate 12 for feeding mastic material into the mastic cavity of the tool. Bracket 19 also provides means for connecting tool 10 to a mastic dispenser having a ball terminal, the construction of which is also well known in this art. Thus, details of the socket bracket form no part of the present invention.

Figure 4:
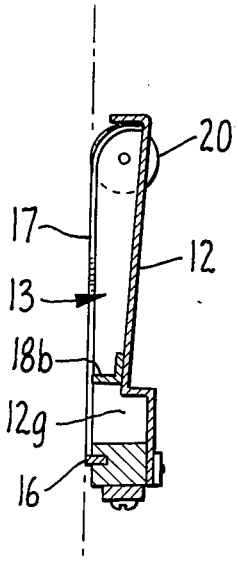
FIG. 4 is a vertical section taken on line 4—4 of FIG. 2.

An additional feature of the invention involves the use of a pair of side rollers 20 mounted peripherally of the mastic cavity on frame members 13 and 14. Referring to FIG. 4, each roller 20 has a rim surface that is substantially tangential with an imaginary plane defined by one surface of roller 11 and the straight line extension of one skid blade 17. These surfaces essentially define the two convergent and substantially perpendicular planes of the wall joint to which mastic material is applied. Rollers 20 enhance positioning of the tool and facilitate movement of the tool along the wall joint.

Figure 7:
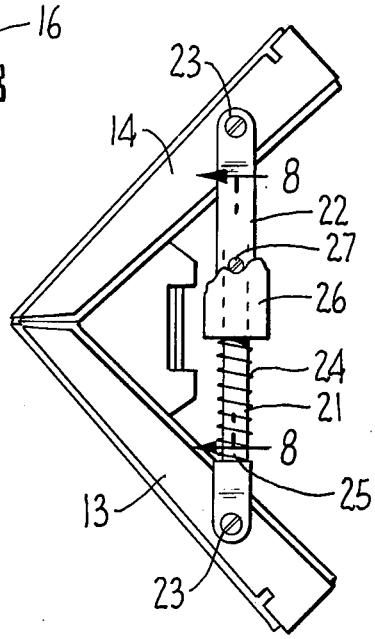
FIG. 7 is a bottom plan view of the tool.
Figure 6:
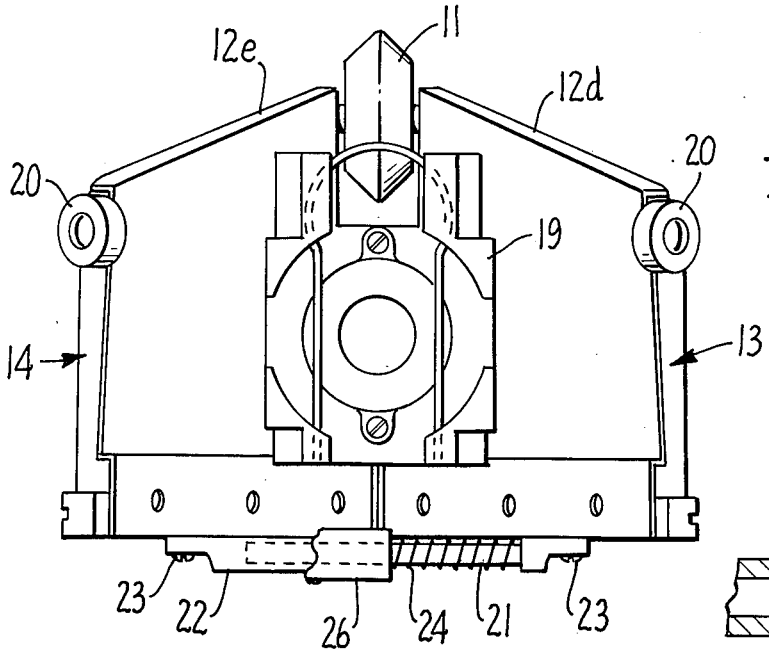
FIG. 6 is a rear elevation of the tool.
Figure 8:
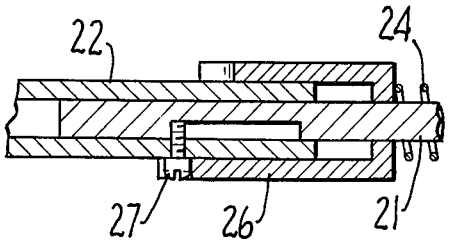
FIG. 8 is a detailed and longitudinal enlarged section taken on lines 8—8 of FIG. 7.

Tool 10 further provides an improved means for adjusting the resilient flex between the pair of integral sides 12*a* and 12*b*. Referring to FIGS. 6, 7 and 8 in particular, there is provided, for this purpose, a rod 21 and sleeve 22, one end of each being pivotally connected by machine screws 23 to the lower side of frame members 13 and 14, respectively. The opposite end of pin 21 is telescopically received within sleeve 22 and, thus, provides an extendible connection between frame members 13 and 14. A helical spring 24 circumvallates pin 21 while seated between a shoulder 25 on pin 21 and the end of a sleeve 26, which is axially slidable and rotatable relative to sleeve 22. However, axial movement of sleeve 26 is limited in one direction by contact with a screw or stop 27 secured to sleeve 22. Furthermore, the end of sleeve 26 nearest stop 27 is shaped to contact the stop at several different axial positions, depending upon the rotational relationship of sleeves 26 and 22.

It will be apparent that different axial position settings of sleeve 26 will place spring 24 under more or less compression, and the compressional force of the spring is varied merely by rotating sleeve 26 relative to sleeve 22. In addition, an increase in the compressional force of spring 24 increases the stiffness in the flex between sides 12*a* and 12*b*.

Referrring to FIG. 8, rod 21 is formed with a slot 21*a* that receives the end of stop 27, and contact between the stop and the end of slot 21 limits extension of rod 21 from sleeve 22. This contact is made when doctor blades 16 are at substantially right angles. Thus, the construction of the means for adjusting the resilient flex allows sides 12*a* and 12*b* to be flexed in a direction that reduces the angular relationship between doctor blades 16 to angles substantially less than 90°, but simultaneously limits reverse flexing, positioning the doctor blades at right angles.

Although a preferred embodiment of the invention has been illustrated and described, various modifications and changes may be resorted to without departing from the spirit of the invention or the scope of the appended claims, and each of such modification and changes is contemplated.

We claim:

1. An improved corner finishing tool for applying mastic material along a wall joint, said tool comprising container means defining a cavity that is open in two convergent and substantially perpendicular planes and having surfaces in each of said planes that converge peripherally of said cavity; said container means comprising an angular retainer plate having a pair of integral sides resiliently joined at a corner, a pair of L-shaped frame members secured to said pair of integral sides, respectively, one side and frame member being resiliently movable relative to the other side and frame member; a pair of doctor blades mounted along intersecting edges of said frame members for doctoring mastic material that flows thereunder; and improved means for adjusting the resilient flex between said pair of integral sides comprising a pin and sleeve telescopically joined, one end of said pin and one end of said sleeve being pivotally secured to one of said integral sides, respectively; a second sleeve mounted on said first sleeve for axial and rotational movement thereon, said second sleeve having an irregular end surface engageable with a stop secured to said sleeve, and a helical spring disposed between said second sleeve and a contact with said pin, said spring applying a resilient force pressing the irregular end surface against said stop and urging said pin in an extended direction relative to said first sleeve.

2. An improved corner finishing tool for applying mastic material along a wall joint, said tool comprising container means defining a cavity that is open in two convergent and substantially perpendicular planes and having surfaces in each of said planes that converge peripherally of said cavity; said container means comprising an angular retainer plate having a pair of integral sides resiliently joined at a corner, a pair of L-shaped frame members secured to said pair of integral sides, respectively, one side and frame member being resiliently movable relative to the other side and frame member; a pair of doctor blades mounted along intersecting edges of said frame members for doctoring mastic material that flows thereunder; each of said pair of integral sides defining an elongate interior pocket located directly in front of said pair of doctor blades for receiving and storing mastic material and collecting foreign particles.

3. The corner finishing tool of claim 2, and further comprising a pair of baffle plates, each plate secured to one of said pair of integral sides and located for restricting the forword flow of mastic material, producing a buildup and forcing the material to flow in a direction toward an interior pocket.

4. The corner finishing tool of claim 3, and further comprising a pair of side rollers rotatably mounted from said container means peripherally of the cavity in advance of said baffle plates, each of said rollers having a rim surface that is substantially tangential with one of the two convergent and substantially perpendicular planes, respectively.

5. An improved corner finishing tool for applying mastic material along a wall joint, said tool comprising container means defining a cavity that is open in two convergent and substantially perpendicular planes and having surfaces in each of said planes that converge peripherally of said cavity; a pair of doctor blades for doctoring mastic material that flows thereunder; said container means comprising an angular retainer plate having a pair of sides resiliently joined at a corner, an opening formed through said retainer plate through which mastic material may be inserted into the cavity, an elongate interior pocket formed in each side of said container means and located in spaced relation to the opening through said retainer plate directly in front of one of said doctor blades for receiving, storing and dispensing mastic material and collecting foreign particles.

6. The corner finishing tool of claim 5 and further comprising means including a pair of baffle plates secured to one of said pair of sides for restricting the forward flow of mastic material from the opening and producing a buildup that forces the material to flow in a direction toward the interior pockets.

* * * * *